US008523005B2

(12) United States Patent
Martin et al.

(10) Patent No.: US 8,523,005 B2
(45) **Date of Patent: *Sep. 3, 2013**

(54) SUPPORTABLE PRESSURIZABLE CONTAINER HAVING A BASE CUP

(75) Inventors: Matthew John Martin, California, KY (US); Scott Edward Smith, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 95 days.

This patent is subject to a terminal disclaimer.

(21) Appl. No.: 12/942,307

(22) Filed: Nov. 9, 2010

(65) Prior Publication Data

US 2011/0049167 A1 Mar. 3, 2011

Related U.S. Application Data

(63) Continuation of application No. 11/894,171, filed on Aug. 20, 2007, now abandoned.

(51) Int. Cl.
*B65D 23/00* (2006.01)

(52) U.S. Cl.
USPC ..... 220/636; 215/376; 220/581

(58) Field of Classification Search
USPC ..... 215/12.1, 370, 372, 376, 386, 393; 220/605, 528, 630, 636, 738, 628, 581; 248/310, 346.1, 346.11
See application file for complete search history.

(56) References Cited

U.S. PATENT DOCUMENTS

| | | | | |
|---|---|---|---|---|
| 3,184,118 A | | 5/1965 | Webster | |
| 2,837,245 A | | 6/1968 | Grebowiec | |
| 3,482,724 A | * | 12/1969 | Heaton | 215/10 |
| 3,722,725 A | | 3/1973 | Kheatni et al. | |
| 3,726,429 A | * | 4/1973 | Doughty | 215/372 |
| 3,927,782 A | | 12/1975 | Edwards | |
| 3,978,232 A | | 8/1976 | Dodsworth et al. | |
| 2,001,000 A | | 2/1978 | Stanley | |
| 4,082,200 A | * | 4/1978 | Guest et al. | 215/376 |
| 4,241,839 A | | 12/1980 | Alberghini | |

(Continued)

FOREIGN PATENT DOCUMENTS

| | | |
|---|---|---|
| EP | 1656968 A | 5/2006 |
| JP | 58-067744 U | 5/1983 |

(Continued)

OTHER PUBLICATIONS

PCT International Search report dated Jan. 13, 2009; 14 Pages.

*Primary Examiner* — Sue A Weaver
(74) *Attorney, Agent, or Firm* — Larry L. Huston; Steven W. Miller

(57) ABSTRACT

A container having a curved bottom and base cup which allows the container to stand upright. The container and base cup are fitted together by a mechanical engagement having portions on the container and base cup. The mechanical engagement of the container is disposed within the bottom cone of the container. The mechanical engagement of the base cup is cantilevered from the bottom of the base cup. Such disposition reduces stress at the interface between the side wall of the container and edge of the base, providing for a smoother transition and better appearance. Also, this disposition provides resistance to separation of the container and base cup during drop impact. The bottom of the container may be curved and have a well therein for receiving the contents of the container and a dip tube.

7 Claims, 6 Drawing Sheets

(56) References Cited

U.S. PATENT DOCUMENTS

| | | | | | |
|---|---|---|---|---|---|
| 4,326,638 | A | | 4/1982 | Nickel et al. | |
| 4,438,856 | A | | 3/1984 | Chang | |
| 4,463,860 | A | | 8/1984 | Yoshino et al. | |
| 4,482,067 | A | * | 11/1984 | Saito et al. | 215/386 |
| 4,552,275 | A | | 11/1985 | Chang et al. | |
| 4,573,604 | A | * | 3/1986 | Guim | 220/605 |
| 4,591,066 | A | | 5/1986 | Moen | |
| 4,694,975 | A | * | 9/1987 | Hagan | 222/1 |
| 4,883,188 | A | * | 11/1989 | Barth | 215/12.1 |
| 4,955,491 | A | | 9/1990 | Marshall et al. | |
| 5,062,537 | A | | 11/1991 | Hayashi | |
| 5,464,129 | A | | 11/1995 | Ho | |
| 2001/0030203 | A1 | | 10/2001 | Weber | |
| 2004/0000048 | A1 | | 1/2004 | Wu | |
| 2006/0177399 | A1 | | 8/2006 | Jourdan et al. | |
| 2009/0050598 | A1 | * | 2/2009 | Huang et al. | 215/376 |

FOREIGN PATENT DOCUMENTS

| | | | |
|---|---|---|---|
| JP | 61-156625 | U | 9/1986 |
| JP | 62-060529 | U | 4/1987 |
| JP | 02-057391 | U | 4/1990 |
| JP | 10-016976 | A | 1/1998 |
| JP | 10-016976 | A | 1/1998 |
| JP | 10-035679 | A | 2/1998 |
| JP | 10-059369 | A | 3/1998 |
| JP | 10-101085 | A | 4/1998 |
| JP | 2006-096365 | A | 4/2006 |
| WO | WO02/055407 | A3 | 7/2002 |

* cited by examiner

SUPPORTABLE PRESSURIZABLE CONTAINER HAVING A BASE CUP

CROSS-REFERENCE TO RELATED APPLICATIONS

This application is a continuation of and claims priority under 35 U.S.C. §120 to U.S. application Ser. No. 11/894,171 filed Aug. 20, 2007 now abandoned.

FIELD OF THE INVENTION

The present invention relates to containers having irregular bottoms and base cups for such containers.

BACKGROUND OF THE INVENTION

Pressurizable containers are well known in the art. Such containers are often used to hold and dispense consumer products, such as shaving cream, air fresheners, cleaners, furniture polish, etc. The container may be pressurized to a pressure greater than atmospheric pressure using propellants, inflatable bags, powered pumps, manual pumps such as a squeeze trigger, etc.

The contents of the container, when pressurized, may be dispensed from a nozzle or other opening juxtaposed with the top of the container. For example, the top of the container may have a neck with a threaded cap as occurs with common soft drinks, so that the contents may simply be poured from the container when the cap is removed. Alternatively, the top of the container may be provided with a nozzle so that the contents are dispensed from the container as a foam, gel, mist or spray. Various other types of dispensing mechanisms are well-known in the art.

In order to accommodate the desired pressure during shipment, storage and transport the walls of the container must be able to withstand and maintain the pressure after manufacture through a variety of temperatures, orientations, and handling by the user. The walls of the container must therefore be thick enough to prevent leakage of the contents under pressure or cracking due to stress. This has been accomplished by providing thicker walls. However, relatively thick walls present the problem of material cost and are viewed as environmentally unfriendly.

One approach to solving this problem has been to provide relatively thin side walls and a hemispherical or otherwise curved base. A hemispherical base resists pressure better than a flat base.

However, this approach provides the disadvantage that the curved base does not allow the container to sit upright on horizontal surfaces such as a shelf or table. Such a base may be considered irregular. By irregular it is meant an upright container having such a base cannot stand upright on a horizontal surface without falling over.

One attempt in the art to overcoming this problem includes fitting a base cup over the hemispherical bottom of the container. The base cup fits around the periphery of the container and has a flat bottom. The flat bottom permits the base cup, and container attached to thereto, to sit upright.

Attachment of the base cup to the bottom of the container has presented yet its own problems. Various groove/projection systems have been proposed for the attachment. The groove/projection systems typically provide a circumferential groove and complementary projection around the container. The groove projection system is typically disposed near the curved bottom of the container, such as the point of tangency between the curved bottom and side wall of the container. The base cup is a complementary projection or groove, which engages the groove or projection of the container. Such engagement provides a mechanical fit which prevents separation of the base cup from the container during ordinary use.

The container with the engagement system must pass regulatory drop tests to ensure safety during handling and shipment. The engagement system must be robust enough to provide both static and dynamic attachment between the container and base cup.

However, such engagement systems present their own problems. The interface between the projection and groove is not always smooth. This results in a noticeable line or ridge, which is unsightly. This effect is exacerbated, if shrink wrap or other labeling is placed around the container. The unsightly line or ridge may appear even more pronounced as one tries to hide it.

This problem may be exacerbated when the container is pressurized. The line between the base cup and container may appear less pronounced under atmospheric conditions. However, when the container is pressurized, expansion may occur. Such expansion may cause further mismatch at the interface between the mating edges of the container and base cup.

One attempt to solve this problem has been to adhesively attach the base cup to the container. This approach provides the disadvantage that an additional material cost in the form of the adhesive occurs. Additionally, an extra manufacturing step has to occur between the manufacture of the container and the attachment of the base cup thereto. The adhesive has to be applied to either or both of the container and base cup, requiring an additional operation and extra machinery.

Yet other problems occur when the container uses a dip tube to dispense contents. The dip tub may not be positioned at the lowest point of the container, allowing contents to be wasted. For example, if a hemispherical-bottom container is held at an angle, the bottom of the dip tube may not be immersed in the contents of the container. One approach to solving this problem has been place a well in the bottom of the container. However, this approach may not be feasible with a container having a hemispherical bottom designed to withstand internal pressure.

Accordingly, there is a need to solve the problems of providing a thin walled container, a container which can sit on a horizontal surface, a container that can sit on a horizontal surface utilizing a base cup, the utilization of a base cup without the need for adhesive attachment, and to have a base cup which mechanically engages in the container without the appearance of an unsightly line at the interface between the container and base cup.

BRIEF DESCRIPTION OF THE DRAWINGS

FIG. 2A shows a base cup with a hole in the bottom. FIG. 2B shows a base cup with a solid bottom.

SUMMARY OF THE INVENTION

Figure 1:
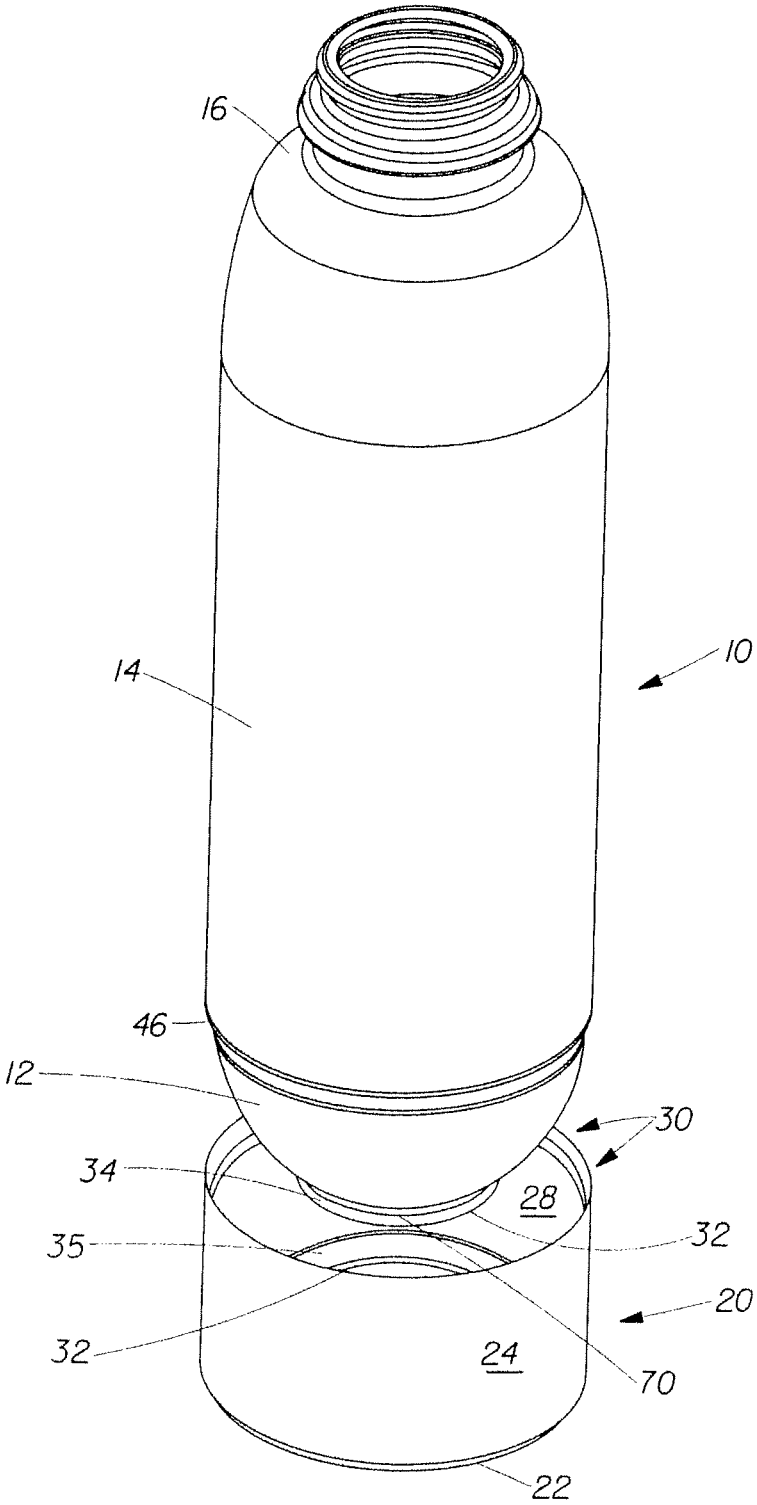
FIG. 1 is an exploded perspective view of a container and base cup according to the present invention.

In one embodiment the invention may comprise a container attachable to a base cup by mechanical engagement. The container has a top, an irregular bottom, side walls, and a point of tangency between the bottom of the container and the side walls. The container has a longitudinal axis therethrough and a 45 degree bottom cone having a vertex disposed on the longitudinal axis at a position corresponding to the point of tangency and diverging outwardly towards the bottom of the container. A mechanical engagement for joining the container to a base cup is disposed on said bottom of the container at least partially within the bottom cone.

In one embodiment the invention may comprise a base cup for supporting a container having an irregular bottom and a longitudinal axis therethrough. The base cup has a bottom for resting on a horizontal surface, a top remote therefrom, a base cup side wall joining the top and bottom of the base cup. An internal perimeter is internal to the base cup side wall and provides a mechanical engagement for engaging a container. The mechanical engagement may comprise an internal engageable portion extending radially inwardly from a proximal end to a distal end, whereby the engageable portion is cantilevered from the bottom of said base cup.

In one embodiment the invention may comprise a container and a base cup attached thereto. The container may have an irregular bottom and side walls visible when the container is disposed on a horizontal surface. The base cup fits over at least a portion of the bottom of the container and allows the container to sit upright on a horizontal surface. A mechanical engagement joins the base cup and said container. The mechanical engagement may comprise complementary engageable portions disposed on the container and base cup, particularly the mechanical engagement may be disposed on being bottom of the container, whereby the side walls of said container are free of said engagement when the base cup is attached thereto.

In one embodiment the invention may comprise a container and a base cup attached thereto. The container may have an irregular bottom and side walls visible when the container is disposed on a horizontal surface. The base cup fits over at least a portion of the bottom of the container and allows the container to sit upright on a horizontal surface. The container and base cup may have alignment tabs, which fit together and provide a reactive force of one component against the other to help maintain these components in the proper position when engaged.

In one embodiment the invention may comprise a container and a base cup attached thereto. The container may have an irregular bottom and side walls visible when the container is disposed on a horizontal surface. The base cup fits over at least a portion of the bottom of the container and allows the container to sit upright on a horizontal surface. The bottom of the container may be curved, and particularly maybe hemispherical. A well may be juxtaposed with the bottom of the container. The base cup has side walls, which intercept the container at a point of tangency.

DETAILED DESCRIPTION OF THE INVENTION

Referring to FIG. 1, the invention comprises a container 10, and more particularly the bottom portion thereof. The container 10 has a has a bottom 12, for indirectly resting upon a surface, a top 16 for dispensing the contents of the container 10 therefrom, and side walls 14 and joining in the bottom 12 and top 16. The container 10 may have a longitudinal axis through the bottom 12 and top 16. The longitudinal axis may be generally vertical when the container 10 is disposed on a horizontal surface. The container 10 may be joined to a complementary base cup 20 for resting upon a surface.

Figure 2A:
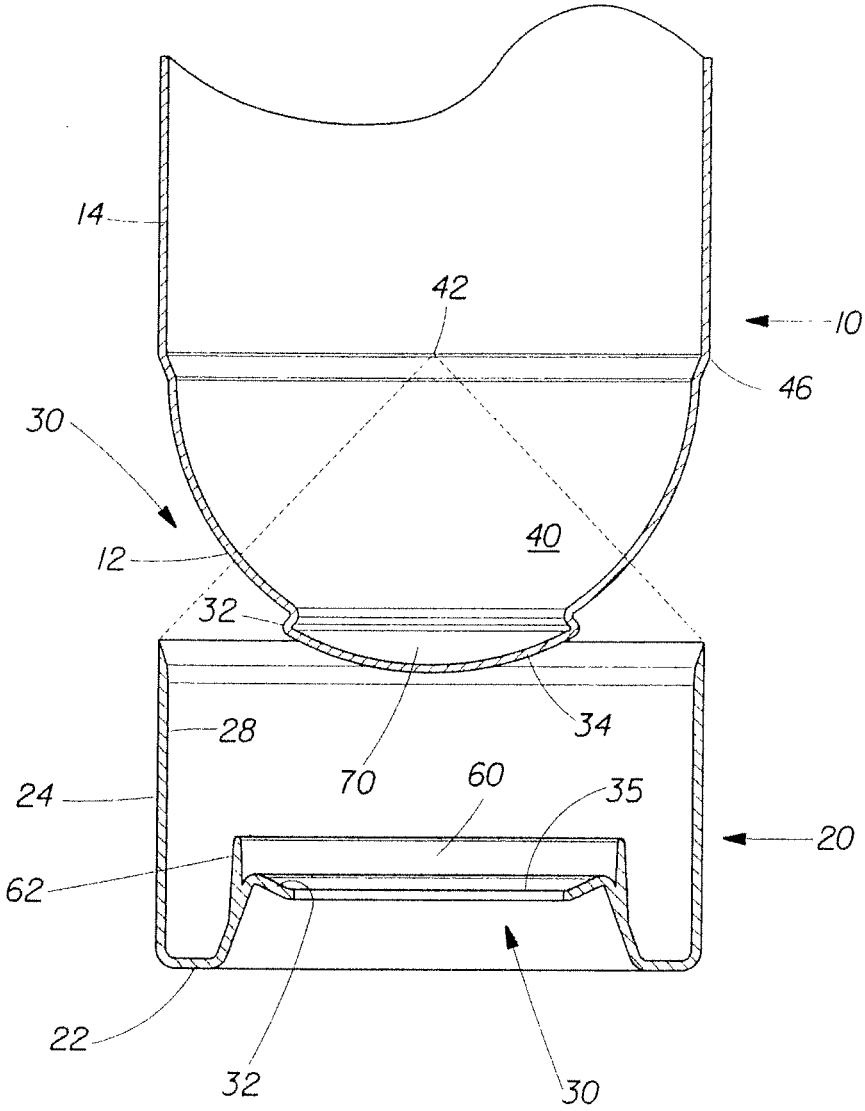
FIGS. 2A and 2B are fragmentary vertical sectional views of the container of FIG. 1 and a base cup having a longitudinal alignment.
Figure 2B:
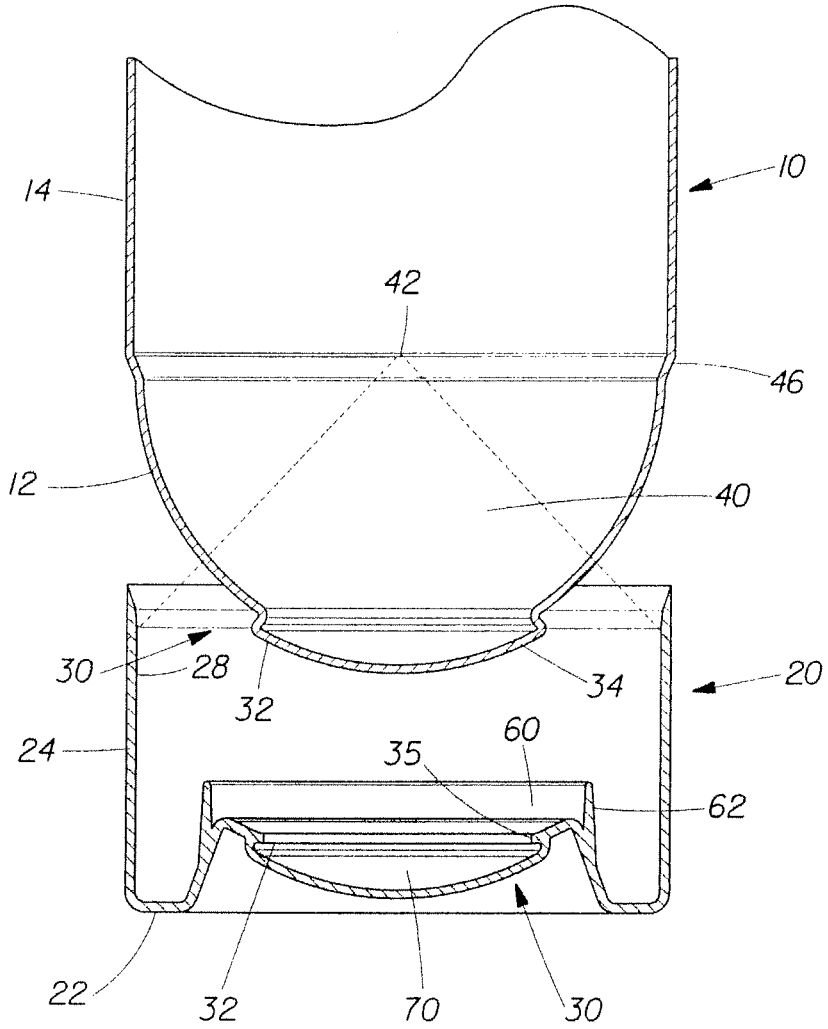

Referring to FIGS. 2A and 2B and examining the components in more detail, the bottom 12 of the container 10 may be irregular, and not allow the container 10 to stand upright on a horizontal surface. The bottom 12 of the container 10 may be eccentric, sloped, tapered, curved, and more particularly, hemispherical as shown. As used herein, an irregular bottom 12 is any bottom 12 not having a substantial cross section perpendicular to the longitudinal axis of the container 10 and which does not allow the container 10 to stand upright on bottom 12 when the container 10 is placed on a horizontal surface. A tapered bottom 12 is a bottom 12 which reduces in cross section in the longitudinal direction as the bottom 12 of the container 10 is approached from the side walls 14. A curved bottom 12 is a tapered bottom 12 which is curvilinear. An irregular bottom 12 does not include champagne bottom or petaloid bottoms, as are well known in the art.

The top 16 of the container 10 may have any dispensing opening juxtaposed therewith which allows for dispensing of the contents of the container 10. The opening may further allow for filling of the container 10 with the contents. The opening may be disposed specifically at the top 16, that is at the highest point of the container 10 when the longitudinal axis is vertical. Alternatively, the opening may disposed in or near the side walls 14 at a suitable distance from the bottom 12 of the container 10. If desired the opening of the container 10 may be disposed at or near the bottom 12 of the container 10. This arrangement provides the benefit that drainage of the contents may occur, even without pressurization. Additionally, such arrangements are inverted from the typical position, and may have an aesthetic appeal as well.

The opening of the container 10 may be a simple aperture, such as is closed with a screw top, snap lid or other closure as are well-known in the art. Alternatively, the opening may be a nozzle, such as is used for spraying liquid contents from the container 10. Pressurization to spray, or otherwise dispense, contents from the container 10 may be provided by a pump, such as a trigger sprayer, propellant, gas, a pressurized internal bag, battery or AC electrical power, etc., as is well known in the art. Of course, if the opening is simply exposed, the contents may be dispensed by pouring from the container 10.

The side walls 14 of the container 10 may provide for any suitable cross-section joining the top 16 and bottom 12 of the container 10. The side walls 14 may define the cross sections of the container 10, which cross sections may be perpendicular to the longitudinal axis. If desired, the side walls 14 of the container 10 may provide a geometry greater in the longitudinal direction than in the radial directions perpendicular thereto.

The container 10 may be of constant cross-section, as shown. Further, the container 10 may have a circular cross-section, providing a generally cylindrical geometry, as shown. Alternatively, various other cross-sections may be utilized, including rectangular, oval, etc. In yet another variation, the container 10 may be of variable cross-section, with suitable cross-sections monotonically tapering in a pyramoidal fashion, etc. The side walls 14 and bottom 12 of the container 10 can meet at a point of tangency 46, so that a specific break is discernible, or the side walls 14 and bottom 12 may have a contoured transition.

The container 10 may be blow molded from any polyolefenic material as is known in the art, or may be made of a laminate construction of recycled and/or virgin materials including PET, PVA, PEN, nylon or may be made of glass or metal or any combination thereof. The container 10 may be coated with carbon, silica or other coatings to provide a diffusion/permeation barrier.

The base cup 20 is any member attachable to the container 10 in a manner which allows the container 10 to stand upright on a horizontal surface and, more particularly may be attachable to the bottom 12 of the container 10. The base cup 20 may be any member formed separate from the container 10 and which provides a transition between the irregular bottom 12 of the container 10 and a surface upon which the container 10 is to be placed. In the specific case of a container 10 having a tapered bottom 12, the base cup 20 may envelope the bottom 12, partially obscuring it from view.

The base cup 20 may have a bottom 22. The bottom 22 of the base cup 20 may be parallel to a cross section of the container 10 and perpendicular to the longitudinal axis. The bottom 22 of the base cup 20 may have a hole therethrough or be solid, as illustrated in FIGS. 2A and 2B.

A base cup side wall 24 may extend upwardly from the bottom 22 of the base cup 20. Either the longitudinal dimension of the base cup side wall 24 or the cross-sectional dimension of the base cup 20 may be greater than the other.

The base cup 20 may be concentric with the container 10, if both have a circular cross section and/or congruent if a different cross section is selected for either the base cup 20 or container 10. The base cup 20 and container 10 may have the same or different cross sections, so long as attachment therebetween is feasible.

The side walls 14 of the container 10 and/or side wall 24 of the base cup 20 may radially expand under pressure when the container 10 is filled with its contents, and/or pressurized. The container 10 and base cup 20 of the present invention are usable with pressures ranging from 20,000 to 25,000 ksm has occurs in the beverage industry. The container 10 and base cup 20 are advantageously usable with higher pressures ranging from 80,000, 90,000 or 100,000 ksm, up to 200,000, 120,000 or 110,000 ksm.

A mechanical engagement 30 may be provided to join the base cup 20 and the container 10, particularly the bottom 12 of the container 10. The mechanical engagement 30 may provide to complementary engageable portions 32 on the base cup 20 and container 10. The mechanical engagement 30 may provide for permanent or removable attachment of the base cup 20 and container 10. This arrangement provides for a two-piece system, i.e. a container 10 and base cup 20 attachable to each other and which remain attached together for the intended life and use, without the need for additional components such as adhesive, or other tertiary components which provide for attachment therebetween or are otherwise necessary to hold the container 10 and base cup 20 together.

Figure 3A:
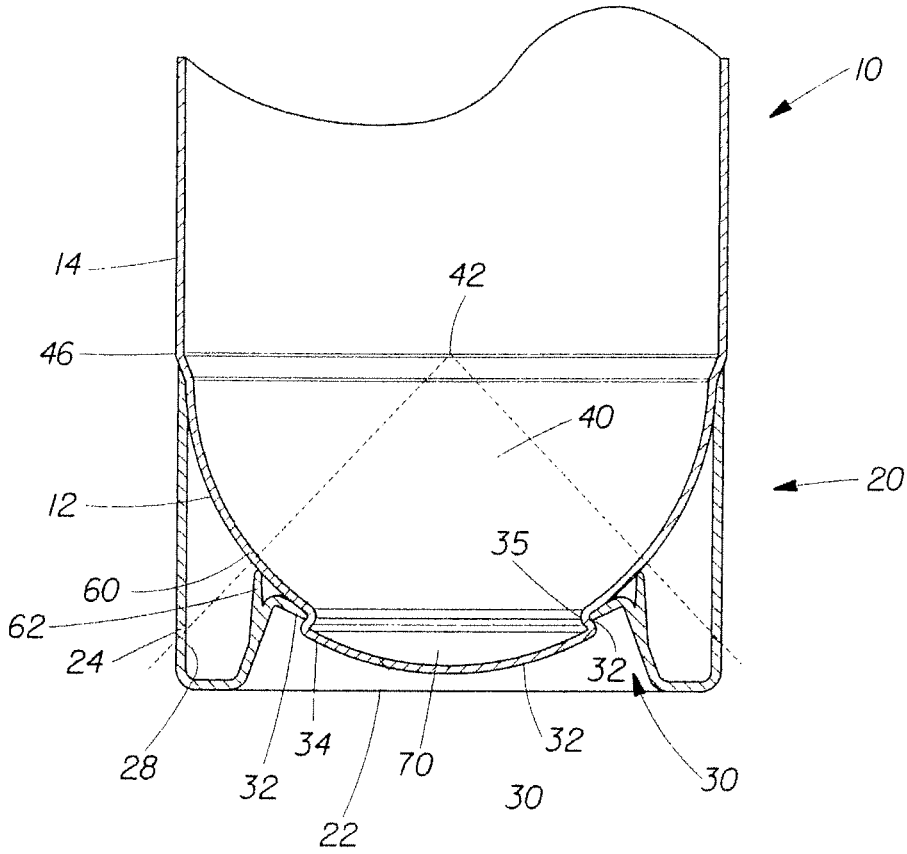
FIGS. 3A and 3B are vertical sectional views of the container and base cups of FIGS. 2A and 2B, respectively, shown in the engaged position.
Figure 3B:
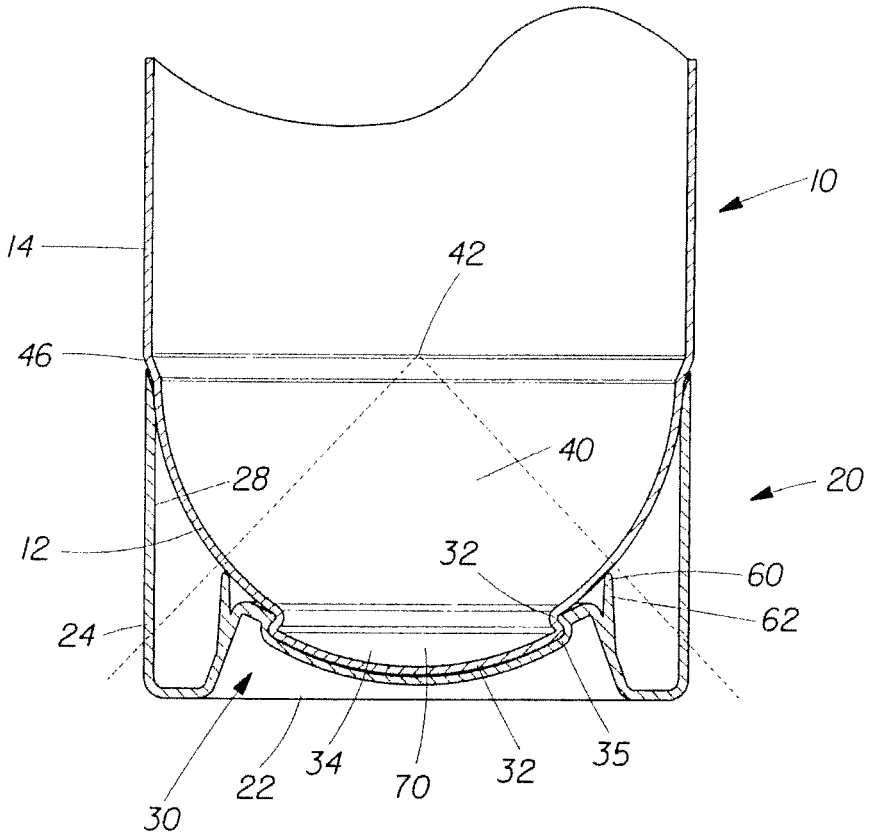

Referring to FIGS. 3A and 3B, the mechanical engagement 30 may provide for attachment of the base cup 20 and container 10 through a friction fit, interlocking engagement, a snap fit, interference fit, etc. The mechanical engagement 30 may comprise any suitable structure which maintains the base cup 20 and container 10 in the intended juxtoposition for the intended life of the container 10. One suitable mechanical engagement 30 comprises complementary engageable portions 32 on the container 10 and base cup 20. Suitable complementary engageable portions 32 include a projection 34 and complementary recess 35. The recess 35 may be in the form of a groove. Either the groove or projection 34 may be disposed on the base cup 20 or container 10, or vice versa The projection 34 may be disposed on the container 10 and recess 35 on the base cup 20, as shown, or vice versa. The mechanical engagement 30 may subtend a full 360 degree circumference around the longitudinal axis or may subtend a lesser arc. Plural mechanical engagements 30 may be utilized, in series, i.e. having different longitudinal position; in parallel, i.e. having different radial or circumferential positions; or both.

The mechanical engagement 30 may be disposed at a location which does not engage the side wall of the container 10. This disposition minimizes movement at the point/line of attachment due to pressurization/depressurization, drop impact, thermal changes, etc. However, not all locations which avoid the side walls 14 are expected to perform equally well.

Referring back to FIGS. 2A and 2B, the mechanical engagement 30 may be disposed within the bottom cone 40 of the container 10. The bottom cone 40 is defined as a right circular cone having its vertex 42 disposed on the longitudinal axis of the container 10 and the axis of the cone coincident the longitudinal axis of the container 10. The base of the cone is a circle perpendicular to the longitudinal axis and parallel to a cross section of the container 10.

The taper of the bottom cone 40 is divergently outward towards the bottom 12 of the container 10 and/or base cup 20. The angle of the taper may be 45 degrees between the longitudinal axis and side of the cone (a 90 degree included angle between opposite sides of the cone), which is inclusive of 40 degree 35 degree, 30 degree and 25 degree angles of taper, respectively.

The vertex 42 of the bottom cone 40 is disposed at the elevation of and corresponding to the point of tangency 46 where the side wall of the container 10 flares or tapers to the bottom 12. The base of the bottom cone 40 is coincident the bottom 22 of the base cup 20 when the base cup 20 is attached to the container 10. If the container 10/bottom 12 have plural points of tangency, the uppermost, lowest, or any intermediate point of tangency may be considered. Considering the lowest point of tangency provides the benefit that a less complex fit may be needed to have the base cup 20 engaged with the bottom 12 of the container 10.

By disposing the mechanical engagement 30 within the bottom cone 40, it is believed the competing forces which hold the container 10 and base cup 20 together during drop impact on the base cup 20 and the forces which cause differential radial expansion at the interface between the side wall of the container 10 and base cup 20 can both be accommodated. The forces are believed to be competing in the prior art, because as radial expansion occurs, the mechanical engagement 30 becomes more secure but the forces transmitted during drop impact are transmitted in the radially expansive direction, allowing disengagement.

The mechanical engagement 30 may be blow molded integral with the container 10 having a projection 34 with a wall thickness greater than the wall thickness of the bottom 12 of the container 10. This difference in thickness provides the benefit that material otherwise depleted from the projection 34 during manufacture is accommodated.

If desired, a well 70 may be juxtaposed with the bottom 12 of the container 10. The well 70 may receive the end of a dip tube therein. The well 70 will typically hold a quantity of the contents of the container 10 to be dispensed. Such contents may be disposed in the well 70 even if the container 10 is tilted at a slight angle from the vertical. By receiving both the end of the dip tube and the contents of the container in the well 70, less contents remain when the propellant is depleted and dispensing may continue when the container 10 is tilted at an angle.

It is to be recognized that the well 70 is a disruption in the curved bottom 12 and does not simply represent the lowest point of curvature. Instead, the well 70 represents additional volume, which would not be present if the curvature was continuous and uninterrupted. If desired the well 70 may have curvature spaced apart from and congruent to the bottom 12 of the container 10.

Referring again to FIGS. 3A and 3B, the projection 34 and recess 35 may fit together in a snap fit, which allows engagement, but does not permit later disengagement or separation. Alternatively, the projection 34 and recess 35 may fit together and be disengageable by reverse movement of the process which fitted the complementary engageable portions 32 together.

Either the projection 34 and/or recess 35 may subtend 360 degrees. This arrangement provides the benefit of the greatest distribution of stresses throughout the circumference of the mechanical engagement.

Figure 4:
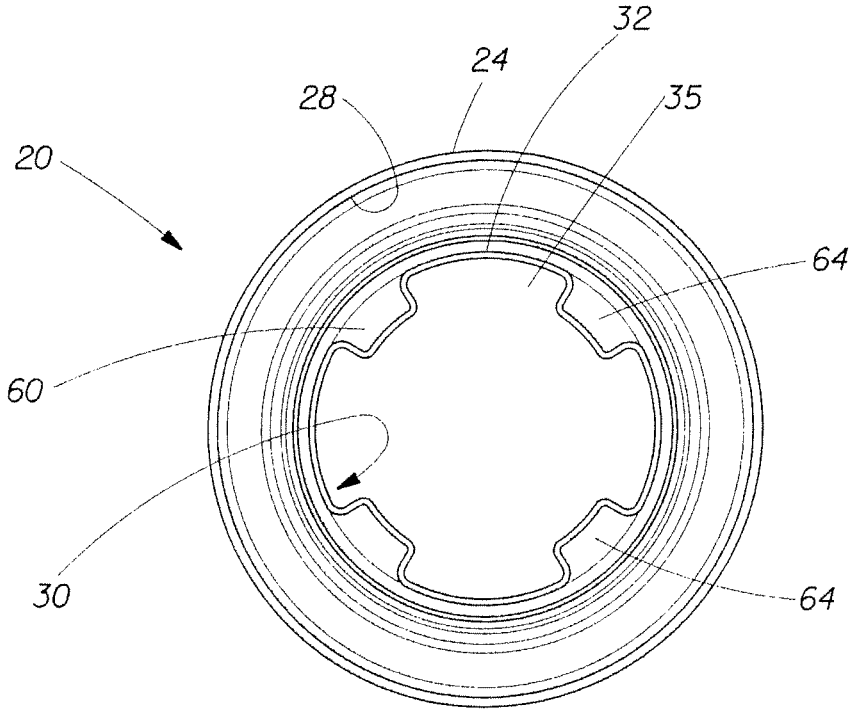
FIG. 4 is top plan view of an alternative base cup having a longitudinal alignment tab and four discrete radial alignment tabs for applying forces in the longitudinal and radial directions, respectively.

Referring to FIG. 4, alternatively, the projection 34 and or recess 35 may comprise three tabs disposed at 120 degrees, four tabs disposed at 90 degrees, etc. This arrangement provides the benefit that less material is utilized to form the tabs.

Referring back to FIGS. 2A-2B, the recess 35 may comprise a blind hole or a through hole, as shown. The blind hole provides the benefit of preventing debris from entering the bottom 22 of the base cup 20 and becoming entrapped. If the container 10 is used in the kitchen, as may occur with cleaners, the debris may comprise food particles which could later spoil. The through hole provides the benefit that less material is necessary to form the recess 35 and base cup 20. Also the through hole may be more forgiving if there is some eccentricity in either the base cup 20 or container 10.

More particularly, referring to the base cup 20, the recess 35 may be defined by the inner perimeter 28 of the base cup 20. The engageable portion 32 of the base cup 20 may extend radially inwardly from the inner perimeter 28 of the base cup 20. More particularly, the engageable portion 32 may be cantilevered from a proximal end at the inner perimeter 28 and extend inwardly, i.e. towards the longitudinal axis to a distal end spaced from the proximal end. The distal end of the engageable portion 32 defines the recess 35 and may engage the engageable portion 32 (such as a projection 34) of the bottom 12 of the container 10.

Referring to FIGS. 3A and 3B, the engageable portion 32 of the base cup 20 may be cantilevered from the bottom 22 of the base cup 20. This arrangement provides the benefit that the reaction which occurs due to engagement with the container 10, does not disturb or displace the base cup side walls 24. Thus, the base cup side wall 24 is relatively free from hoop stress and other stresses. By being relatively free from stresses, the base cup side wall 24 may have a smoother transition at the interface with the container 10 side wall. The smoother transition provides the benefit of a more aesthetically pleasing appearance, particularly when a label is attached to the container 10 and base cup 20.

The engageable portion 32 may extend diagonally inwardly and upwardly from the bottom 22 of the base cup 20, as shown. This geometry provides the benefit of greater section modulus and, hence greater rigidity in the longitudinal direction, particularly the longitudinally compressive direction. Alternatively, the engageable portion 32 may extend diagonally inwardly and upwardly from the bottom 22 of the base cup 20. This geometry provides the benefit that a shorter engageable portion 32 occurs, and less material is used to make the engageable portion 32.

The projection 34 which is inserted into the recess 35 may have a longitudinal dimension and a radial dimension orthogonal thereto. The radial dimension may be greater than the longitudinal dimension. This provides the benefit of a relatively longitudinally compact design. Such design disposes the interface being the top 26 of the base cup 20 and the side wall of the container 10 closer to the bottom 22 of the base cup 20, potentially reducing the aesthetic effect of this interface.

If desired, the base cup 20 may have a modular construction. In a modular construction the bottom 22 of the base cup 20 may be formed of one or more different materials than the base cup side walls 24. This modular construction provides the benefit that the bottom 22 may be formed of a less expensive material, since it is typically not visible in use or while the package is seen on the store shelf. Additionally, the bottom 22, may be formed of a relatively stronger material and be suitable for maintaining its engageable portion 32 throughout its expected life. The bottoms 22 may be provided with various sizes of projections 34 or recesses 35, to be complementary to the corresponding engageable portion 32 of the container 10.

The side walls 24 of the base cup 20 may be made in various colors, textures, sizes, etc. to provide different aesthetics, or to accommodate different sized bottoms 12 of the container 10. The side walls 24 and bottom 22 of the base 20 may be joined by adhesive, sonic or ultrasonic welding, friction welding, a snap fit, etc. as is well known in the art.

The base cup 20 may be injection molded. If so, it may be desirable to avoid certain placements of the gates used for material supply during injection molding process. For example, disposing a gate on the engageable portion 32, and particularly the distal end of the engageable portion 32 of the base cup 20 may lead to premature cracking of the engageable portion 32. This phenomenon is believed to be due to the differential cooling associated with such placement of the gates. Either or both of the container 10 and/or base cup 20 may be transparent, translucent, or opaque.

Referring to FIG. 4, the base cup 20 may comprise a polyolefinic material such as polyethylene. Alternatively, the base cup 20 may be made of metal, wood or stiff paper.

The base cup 20 may have alignment tabs 60. An alignment tab 60 is any member disposed on or which reacts against the base to exert a force on the mechanical engagement 30. The force may be applied in the radial direction and/or the longitudinal direction when the container 10 and basic cup 20 are engaged. The alignment tabs 60 may be elastically or plastically deformable. Such deformation may occur during assembly and attachment of the container 10 and base cup 20.

The alignment tabs 60 provide a secure fit between the base cup 20 and bottom 12 of the container 10. The alignment tabs 60 exert a force between these components, preventing rattle and a loose fit. This provides the benefit that the package is perceived to be of higher quality.

If elastically deformable alignment tabs 60 are selected, the alignment tabs 60 may be more flexible than the projection 34 and walls of the recess 35 which make up the mechanical engagement 30. Such flexibility may be provided using a material having greater compliance, then the materials forming the mechanical engagement 30, and/or use relatively thinner wall sections to reduce the section modulus of such alignment tabs 60. Suitable material for the alignment tabs 60 includes TPE.

The alignment tabs 60 may be cantilevered from the base cup 20, and particularly from the bottom 22 of the base cup 20. The alignment tabs 60 may taper along an axis from a proximal end to a distal end. This taper provides a variable spring rate in the direction perpendicular to the taper throughout the longitudinal axis and increasing as the proximal end is approached. Such variable spring rate provides the advantage that differences in fit and alignment may be accommodated.

A longitudinal alignment tab 62 may extend with a vector component parallel to the longitudinal axis. In a degenerate case, the longitudinal alignment tab 62 may be parallel to the longitudinal axis. A radial alignment tab 64 may extend inwardly towards the longitudinal axis. Of course, one of skill will recognize that forces in other directions, not parallel to the radial or longitudinal directions, but instead which are diagonal thereto may be exerted by the alignment tabs 60 as well.

The proximal end of the alignment tab 60 may be joined to the bottom 22 or sidewall 24 of the base cup 20. The distal end of a radial alignment tab 64 may engage or intercept the projection 34 and particularly any inside corner or annular groove within the projection 34. This reduces the likelihood that the distal end of the alignment tab 60 will become dislodged during shipping and handling.

The distal end of a longitudinal alignment tab 62 may intercept the bottom 12 of the container 10. This provides a force perpendicular to the bottom 12 of the container 10, and, in the case of a container 10 having a hemispherical bottom 12, also exerts a force radially inwardly. If the longitudinal alignment tab 62 (or a radial alignment tab 64) circumscribes the mechanical engagement 30, equal and opposite radial forces will be applied, helping to maintain concentricity. Thus, the alignment tabs 60 provide the benefit that manufacturing tolerances and mismatch between parts can be accommodated.

If the alignment tabs 60 are elastically deformable, they may act as springs, applying relatively constant force to the mechanical engagement 30. If the alignment tabs 60 plastically de form during assembly, they will fill some of the void space inherent in the mechanical engagement 30 and reduce movement which would otherwise occur between components in that void space.

One of skill will recognize that the alignment tabs 60 maybe cantilevered from the projection 34 or from elsewhere on the bottom 12 of the container 10. In this arrangement, the distal end of the alignment tabs 60 will intercept the inside of the based cup sidewall 24, and/or the bottom 22 of the base cup 20. Further, the alignment tabs 60 may be equally and/or unequally spaced around in the longitudinal axis and may be continuous or discontinuous, i.e. discrete. Further, the longitudinal alignment tabs 62, and the radial alignment tabs 64 may apply equal forces or either may apply a greater or lesser force than the other.

Following assembly of the base cup 20 to the container 10, either or both of the base cup 20 and/or container 10 may be decorated with various labels, graphics, advertising, instructions for use and other indicia. This decoration may be accomplished through printing, adhesively attached labels, shrink wrap labels, etc. If the indicia bridges the longitudinal (vertical) dimension, between the container 10 and the base cup 20, the indicia may be disposed outside both the container 10 and based cup 20. This arrangement provides the benefit that the graphics may appear larger when the package is presented on the store shelf. Alternatively, the indicia may be disposed outside of the container 10 and tucked inside the base cup 20. This arrangement provides the benefit that if the bottom of the indicia is not accurately trimmed, it will be covered by the base. Additionally, if it is desired to have a base cup 20 of a particular color, such base cup 20 will not be covered by the indicia.

The container 10 may be used to hold, store and dispense any suitable contents. The contents may be usable as consumer products or otherwise. For example, the contents may be used as a cleaning product, air freshener, disinfectant, topical application to the skin, furniture polish, etc. If the contents are to be used as a furniture polish with wood surfaces, the container 10 may be made of brushed aluminum, or other material having a brushed aluminum appearance. Such a container 10 may have a wood indicium thereon, to show the intended use of the furniture polish therein. This combination advantageously provides the benefit of a modern looking container 10 with a warm looking indicium of wood thereon.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container and an exterior base cup attached thereto;

the container and base cup being freestanding and having a longitudinal axis therethrough, the container having a curved container bottom and container side walls visible when the container is disposed on a horizontal surface, said container side walls extending outwardly from said curved container bottom and intercepting said container curved bottom at a point of tangency;

the base cup fitting over at least a portion of said curved bottom of said container and having a base cup bottom allowing said base cup and said container to sit upright on a horizontal surface, said base cup having base cup side walls extending outwardly from the bottom of said base cup and intercepting said side walls of said container at said point of tangency; and a mechanical engagement which joins said base cup and said container, said mechanical engagement not intercepting said longitudinal axis and being disposed radially outward thereof, said mechanical engagement comprising complimentary engageable portions disposed on said container and on said base cup, a portion of said mechanical engagement being disposed on said bottom of said container, whereby said side walls of said container are free of said engagement when said base cup is attached thereto, said base cup sidewalls not having said mechanical engagement thereon, wherein said base cup side walls are free of said complimentary engageable portion.

2. A container and a base cup attached thereto according to claim 1, wherein said bottom of said container is hemispherically shaped.

3. A container and a base cup attached thereto according to claim 2 wherein said bottom of said container is hemispherically shaped, and further comprising a well.

4. A container and a base cup attached thereto according to claim 1 wherein said side walls of said base cup are cylindrical and straight in an axial direction perpendicular to a cross section of said cylinder.

5. A container and an exterior base cup attached thereto, said container and said base cup having a longitudinal axis therethrough;

the container being internally pressurized and having a curved bottom and side walls visible when the container is disposed on a horizontal surface, said side walls extending outwardly from said curved bottom and intercepting said curved bottom at a point of tangency;

the base cup fitting over at least a portion of said curved bottom of said container and having a bottom allowing said base cup and said container to sit upright on a horizontal surface, said base cup having side walls extending outwardly from the bottom of said base cup and intercepting said side walls of said container at said point of tangency; and a mechanical engagement which joins said base cup and said container and comprises complimentary engageable portions disposed on said container and on said base cup, a portion of said mechanical engagement being disposed on said bottom of said container, said mechanical engagement not intercepting said longitudinal axis and being disposed radially outward thereof, whereby said side walls of said container are free of said engagement when said base cup is attached thereto, said base cup sidewalls not having said mechanical engagement thereon, wherein said base cup side walls are free of said complimentary engageable portion.

6. A container and a base cup attached thereto according to claim 5 pressurized to 80,000 to 120,000 ksm.

7. A container and a base cup attached thereto according to claim 6 pressurized to 90,000 to 110,000 ksm.

* * * * *